US005685479A

United States Patent [19]

Weber-Caspers

[11] Patent Number: 5,685,479

[45] Date of Patent: Nov. 11, 1997

[54] BOX-LIKE PACKAGING WITH DISPENSING OPENING AND BLANK FOR MAKING SAME

[75] Inventor: Martin Gerhard Weber-Caspers, Lelystad, Netherlands

[73] Assignee: Crystal B.V., Almere, Netherlands

[21] Appl. No.: 333,287

[22] Filed: Nov. 2, 1994

[30] Foreign Application Priority Data

Nov. 5, 1993 [NL] Netherlands ..... 9301925

[51] Int. Cl.[6] ..... B65D 5/70; B65D 5/74

[52] U.S. Cl. ..... 229/125.42; 229/217; 229/219

[58] Field of Search ..... 229/125.42, 217, 229/219, 248, 249, 215

[56] References Cited

U.S. PATENT DOCUMENTS

| | | | |
|---|---|---|---|
| 1,704,987 | 3/1929 | Marsh | 229/219 |
| 1,974,925 | 9/1934 | Marsh | 229/125.42 |
| 2,300,703 | 11/1942 | Ray | 229/217 |
| 2,811,297 | 10/1957 | Maxon | 229/219 |
| 2,861,732 | 11/1958 | Parker | 229/217 |
| 3,081,927 | 3/1963 | Hayhurst | 229/125.42 |
| 3,107,038 | 10/1963 | Kuchenbecker | 229/217 |
| 3,269,644 | 8/1966 | Bump . | |
| 3,421,680 | 1/1969 | Cohee . | |

FOREIGN PATENT DOCUMENTS

| | | | |
|---|---|---|---|
| 700576 | 12/1964 | Canada | 229/217 |

*Primary Examiner*—Gary E. Elkins
*Attorney, Agent, or Firm*—Kinney & Lange, P.A.

[57] ABSTRACT

A box-like packaging comprises at least three adjoining sidewalls which are successively connected through fold lines which form the edges of the packaging. At least one sidewall is connected through a fold line at a lower edge thereof with a bottom panel which closes the packaging at the underside. The packaging comprises a relatively large dispensing opening which can be passed from a closed position into an opening position through folding, the dispensing opening comprising a spout-shaped dispensing surface. The bottom panel and a top panel of the box are substantially flat and extend parallel to each other. The packaging comprises structure for sealing integrally connected with the packaging manufactured from one material portion.

20 Claims, 12 Drawing Sheets

BOX-LIKE PACKAGING WITH DISPENSING OPENING AND BLANK FOR MAKING SAME

BACKGROUND OF THE INVENTION

This invention relates to packaging such as a box. The box has at least three adjoining sidewalls successively connected through fold lines which form the edges of the packaging. At least one sidewall, at a lower edge thereof, is connected through a fold line with a bottom panel which closes the packaging at the underside. The packaging comprises a relatively large dispensing opening which can be passed from a closed position to an opening position through folding. The dispensing opening comprises a spout-shaped dispensing surface. The box has a top panel which is substantially flat and extending parallel to the bottom panel. The packaging comprises sealing means which are integrally connected with the packaging, which is manufactured from one material portion.

Such a packaging is disclosed in U.S. Pat No. 3,421,680. The known packaging has the drawback that it is not reclosable such that it is guaranteed that the dispensing opening remains in the reclosed position. Accordingly, in the reclosed position the dispensing opening will not completely close off the packaging from the surroundings, which detracts substantially from the storage life of the contents of the packaging. Another drawback of the known packaging is that the sprinkle or pour opening in the open position must be tilted through more than 90° for sprinkling or pouring out the contents of the packaging. Because of this large tilting movement, there is a substantial chance of the contents of the packaging being spilt. In order to reduce the risk of spillage, the known packaging will not be filled completely, with the result that the packaging includes a wasted space which is filled with air. Such wasted space filled with air has an adverse effect on the storage life of a perishable product contained in the package.

Another packaging with a sprinkle or pour opening, which does not have the drawback that it must be tilted through more than 90° to be emptied and which at the same time closes properly in the reclosed position and remains closed, is known from practice in the design of a milk carton. In this known milk carton, the dispensing opening is in a stable position, both in the opened and in the reclosed condition, the dispensing opening parts having to be moved through a dead center to pass from one stable position to the other stable position. To provide such a dead center, it is necessary for the packaging not to be flat at the location of the dispensing opening. A disadvantage of the known milk cartons is that the top thereof is not flat, so that the known packagings provided with a relatively large dispensing opening are not stackable. The milk carton provided with a non-flat top moreover has the disadvantage that in filled condition it includes an empty space, i.e. a space filled with air, which occupies about 10% of the volume of the packaging. Other milk cartons known from practice which do have a substantially flat top and bottom can only be opened with the aid of a tool such as scissors or a knife and therefore do not feature a dispensing opening which can be passed from a closed to an opened position through folding. Moreover, these packagings which can be opened with a tool are not reclosable.

One object of the present invention is to improve the known stackable box-shaped packaging of this type in such a manner that the dispensing opening thereof is reclosable and does not uncontrollably assume a half-open position in the reclosed position. The packaging thus allows the contents thereof to be dispensed in a directed manner without requiring that the packaging be tilted through a large angle. Another object of the present invention is to provide a packaging which, by virtue of its design, can be filled to a maximum and accordingly, in filled condition, contains an empty space of minimal volume. A further object of the present invention is to provide a box-like packaging from which it can be seen unequivocally whether it has already been opened or is still unused.

SUMMARY OF THE INVENTION

To that end, the box-like packaging is characterized by having means which positively keep the dispensing opening, once it has been opened, in a reclosed position.

By virtue of the presence of the means for positively keeping the dispensing opening in the reclosed position, it is guaranteed that the contents of the packaging are indeed not in contact with the surroundings of the packaging in the reclosed position thereof. By virtue of the spout-shaped dispensing surface the contents of the box-like packaging can be dispensed in a directed manner. By virtue of the feature that the box comprises flat bottom and top panels extending parallel to each other, the packagings are stackable. The sealing means integrally connected with the packaging are to be removed or locally pulled off the packaging for opening the dispensing opening. If the sealing means have been pulled loose or removed, this is unmistakably visible to subsequent users, and so it will be clear to these subsequent users that the opening has already been opened once.

In further elaboration of the invention, the box-like packaging is characterized by having the three adjoining sidewalls connected with a dispensing opening panel of one-piece design through a fold line coinciding with an upper edge. The fold lines forming the edges and interconnecting said three adjoining sidewalls intersect the upper edge of the adjoining sidewalls in a point of intersection and continue as dispensing opening panel fold lines into the dispensing opening panel, whereby the dispensing opening panel is divided into three dispensing opening panel sections. A dispensing surface fold line is provided, running from each point of intersection at an angle with the dispensing opening panel fold lines and forming the dispensing surface. The dispensing surface fold line extends in the dispensing opening panel section, adjacent to the central sidewall of the adjoining sidewalls, in the direction of the edge thereof remote from the upper edge of the sidewall. A second fold line, referred to as dispensing opening fold line, extends from each point of intersection at an angle with the dispensing opening panel fold lines in the direction of an opening edge bounding the dispensing opening. One of the sidewalls is connected directly or indirectly with the top panel, extends perpendicularly to the other sidewalls, and comprises sealing means integrally connected with the packaging.

A so-designed packaging can be advantageously manufactured from a minimal amount of material. The dispensing surface fold lines running at an angle with the dispensing opening panel fold lines bound a dispensing surface over which the contents of the box slide or flow and which allows the contents to be dispensed in a directed manner.

According to a further elaboration of the invention, the packaging is characterized by having the opening edges bounding the dispensing opening formed by the edge of the dispensing opening panel remote from the upper edge of the sidewall. The dispensing opening fold lines are thus located in the dispensing opening panel sections bounding the central dispensing opening panel section. Top panel material portions under which a part of the dispensing surface can be snapped to positively keep the dispensing opening in a reclosed position.

In this embodiment, the dispensing spout in closed condition is folded flat on the top of the packaging and is reclosable on each occasion. A part of the dispensing surface is snapped under portions of the top panel, which top panel portions constitute the means for positively keeping the dispensing opening in the reclosed position. Because in the open condition the opening extends entirely above the top panel of the packaging, the packaging can be filled optimally, i.e. up to the top panel. Thus an optimum ratio between the volume of the packaging and the required amount of packaging material is obtained.

In an alternative further elaboration of the invention, the packaging is characterized by having the opening edges bounding the dispensing opening formed by a cut provided in the central sidewall of the three adjoining sidewalls and the dispensing opening panel section adjacent thereto. The cut extends parallel to the edges from the middle of the free edge of the central dispensing opening panel section to a point located on the central sidewall, which point is equidistantly spaced from the edges bounding the central sidewall. A closing tab connected with the top panel and comprising adhesive which can be used several times to positively keep the dispensing opening in a reclosed position.

Such a dispensing opening is intended in particular for products which are used up entirely directly after the packaging is opened. However, should the user nevertheless wish to reclose the packaging, then for that purpose the packaging comprises the closing tab, which contains re-adhesive glue. The manufacture of this packaging is extremely simple because the folding operations for forming the blank into the folded packaging are of the most elementary type.

In the embodiment which is most practical from the point of view of manufacturing technique, the box is characterized by, having the box, in addition to the three adjoining sidewalls, comprise a fourth sidewall which, at the upper edge thereof, is connected with the top panel through a fold line, with the sidewalls extending perpendicularly to each other.

Such rectangular boxes can be transported in a densely stacked arrangement by virtue of the substantially flat top and bottom thereof as obtained according to the invention.

The present invention further relates to a blank for manufacturing a box-like packaging according to the invention.

BRIEF DESCRIPTION OF THE DRAWINGS

Further elaborations of the invention will be clarified on the basis of a large number of exemplary embodiments with reference to the drawing. In the drawing.

DESCRIPTION OF THE PREFERRED EMBODIMENTS

Figure 1:
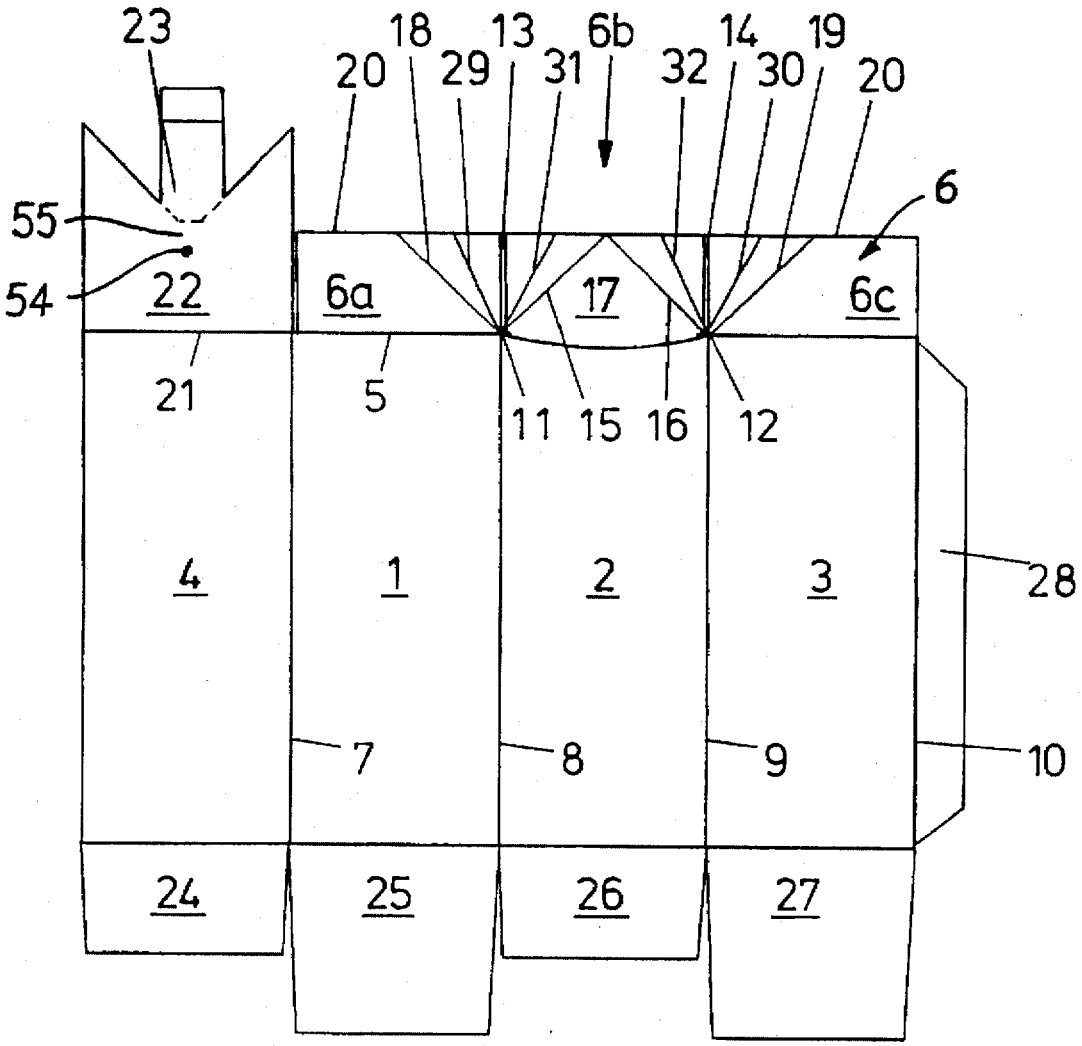
FIG. 1 shows a blank of a first and a second exemplary embodiment of the box partly shown in FIGS. 2–4 and FIGS. 5–7, respectively.

All of the embodiments shown in the drawings feature parallel tops and bottoms, so that the boxes are stackable. In addition, all embodiments comprise sealing means integrally connected with the packaging manufactured from one material portion. Further, all embodiments comprise a dispensing surface by means of which the contents of the box can be dispensed in a directed manner.

The blank of a basic embodiment as shown in FIG. 1 comprises four sidewalls 1–4, of which three adjoining sidewalls 1–3 are connected with a dispensing opening panel 6, designed in one piece, through a fold line 5 coinciding with an upper edge 5. The fold lines 8, 9, forming the edges 8, 9 and connecting the three adjoining sidewalls 1–3 to each other, intersect the upper edge 5 of the adjoining sidewalls 1–3 in points of intersection 11, 12 and continue into the dispensing opening panel 6 as dispensing opening panel fold lines 13, 14. Accordingly, the dispensing opening panel fold lines divide the dispensing opening panel into three dispensing opening panel sections **6*a*, 6*b*, 6*c*. From each point of intersection 11, 12 extends a dispensing surface fold line 15, 16 running at an angle with the dispensing opening panel fold lines 13, 14 and bounding a dispensing surface 17. The dispensing surface fold lines 15, 16 are provided in the dispensing opening panel section 6*b*, which connects to the central sidewall 2 of the adjoining sidewalls 1–3, and extend in the direction of an edge 20 of the dispensing opening panel section 6*b*, remote from the upper edge 5 of the sidewall. From each point of intersection 11, 12 extends a second fold line 18, 19, referred to as dispensing opening fold line 18, 19, extending at an angle with the dispensing opening panel fold lines 13, 14 in the direction of an opening edge 20 bounding the dispensing opening. The opening edge 20 bounding the dispensing opening is formed in this embodiment by the edge of the dispensing opening panel 6 remote from the upper edge 5. In the exemplary embodiment shown in FIG. 1, the dispensing opening fold lines 18, 19 are located in the dispensing opening panel sections 6***a*, 6*c*, bounding the central dispensing opening panel section 6*b*. The blank shown in FIG. 1 yields a box with four mutually perpendicular sidewalls 1–4. The fourth sidewall 4, which is not connected with the dispensing opening panel 6, is connected, through a fold line 21 coinciding with the upper edge 21, with a top panel 22 which in the folded condition extends perpendicularly to the sidewalls 1–4. The top panel 22 comprises sealing means 23 which cover the dispensing opening panel sections 6*a*–6*c* at least partly in the closed, as yet unopened condition of the box. The sealing means 23 shown are connected with the top panel 22 through a perforation line 33.

At the lower end thereof, the blank of FIG. 1 comprises bottom panel sections 24–27, which close the box at the bottom. Further, the sidewall 3, at a longitudinal edge 10 thereof, comprises an adhesive strip 28 for connecting the third sidewall 3 with the fourth sidewall 4. The blank shown in FIG. 1 moreover comprises third fold lines 29–32, referred to as bulge fold lines, extending from the points of intersection 11, 12 in the direction of the opening edge 20. The bulge fold lines 29–32 are located in the area bounded by the dispensing surface fold lines 15, 16 and the dispensing opening fold lines 18, 19. By virtue of such bulge fold lines 29–32, the shape and hence the dimensions of the dispensing opening can be influenced by the user in the open condition and moreover the dispensing opening has acquired a somewhat rounder configuration.

Figure 2:
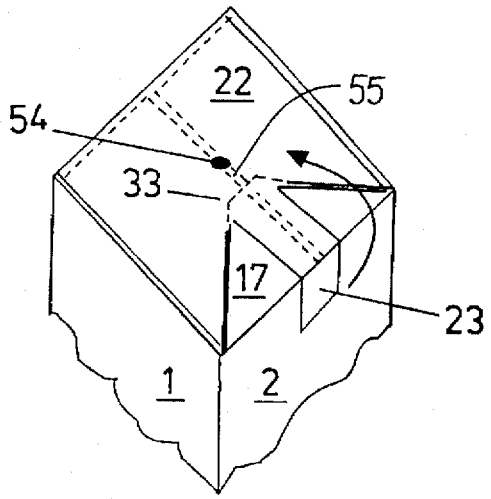
FIGS. 2–4 show the opening of a first exemplary embodiment of the box.
Figure 3:
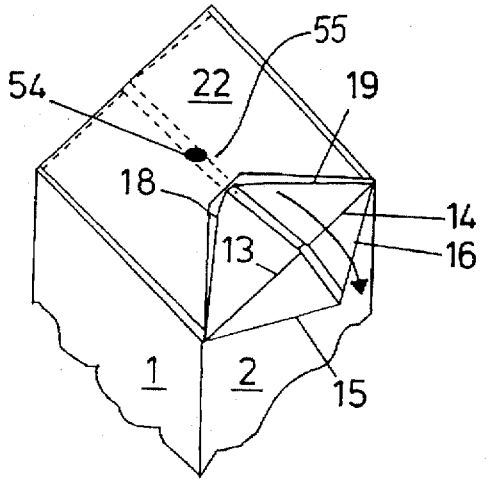
Figure 4:
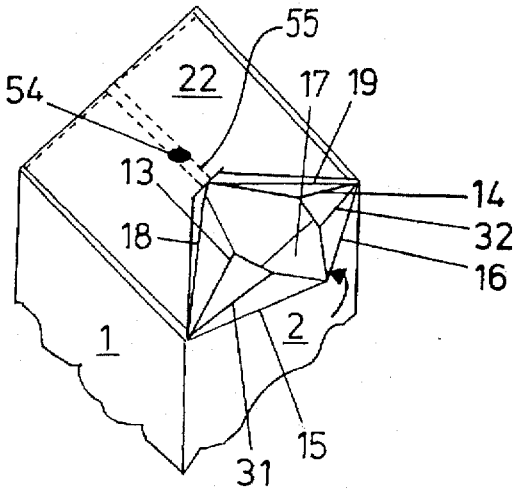

The blank of FIG. 1 and particularly the dispensing opening thereof can be folded up in two different ways. Before the dispensing opening of the packaging is folded up, it is possible, in particular in the case of liquid-tight packagings, to provide adhesive adjacent the opening edge 20. FIGS. 2–4 show a first method of folding up the dispensing opening. FIG. 2 shows the box in the as yet unopened condition, provided with a seal 23 which is connected with the top panel 22 through a perforation line 33. After removal of the seal 23 the dispensing opening can be opened. FIG. 3 shows the dispensing opening in half-open condition. According to the first method of folding up the dispensing opening, the dispensing opening panel fold lines 13, 14 are folded against the upper edge 5 of the central sidewall 2, whereafter the dispensing surface 17 is folded on top of the box. FIG. 4 shows the dispensing opening in the opened condition.

Figure 5:
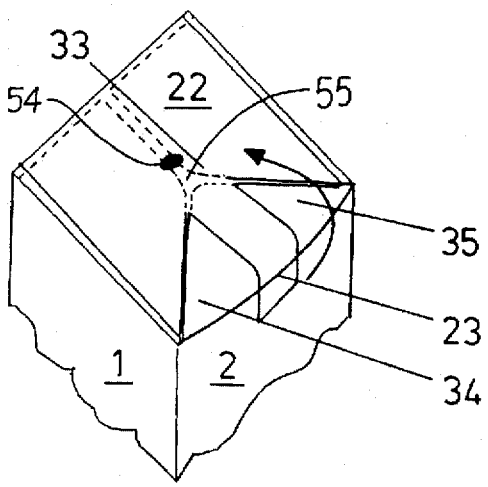
FIGS. 5–7 show the opening of a second exemplary embodiment of the box.
Figure 6:
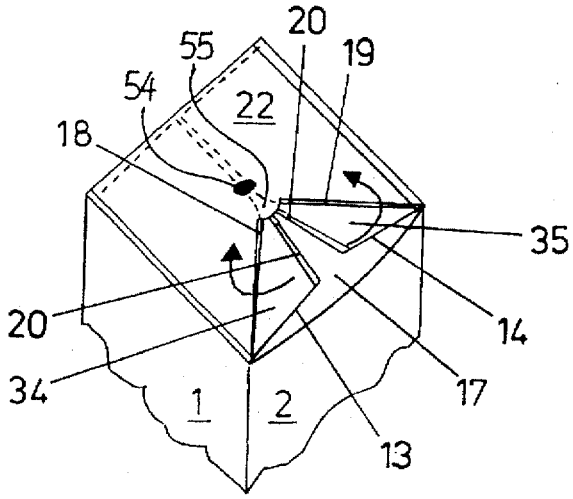
Figure 7:
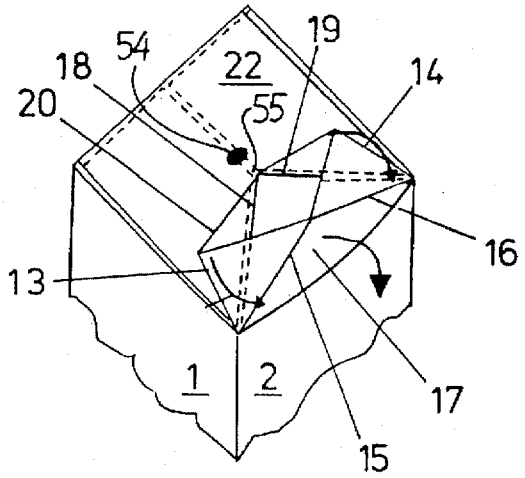

The second method of folding up the dispensing opening of a box made from a blank according to FIG. 1 is shown in FIGS. 5–7. According to this second method, first the dispensing surface 17 is folded on the top of the box, whereafter the triangular double-layer material flaps 34, 35 bounded by the dispensing opening fold lines 18, 19, the dispensing opening panel fold lines 13, 14 and the dispensing surface fold lines 15, 16, are folded on the dispensing surface 17 again.

The top panel 22 is a substantially rectangular material portion provided with a recess 36 which is substantially triangular after the seal 23 is removed and in which the dispensing surface 17 is receivable. The means ensuring that the dispensing opening is positively retained in the reclosed position are here formed by the top panel portion 55 which gives the substantially triangular recess 36 a contour slightly deviating from the triangular form, so that the triangular dispensing surface 17, by the point thereof, at opening edge 20 must, be pressed under the top panel portion 55 in order to bring the dispensing surface 17 into the reclosed position. Further, the recess is partly filled by a removable sealing flap 23 which is connected with the top panel 22 through a perforation line 33. To cause the dispensing surface to snap from under the top panel portion 55 again, the pressure point 54 should be pressed.

Figure 8:
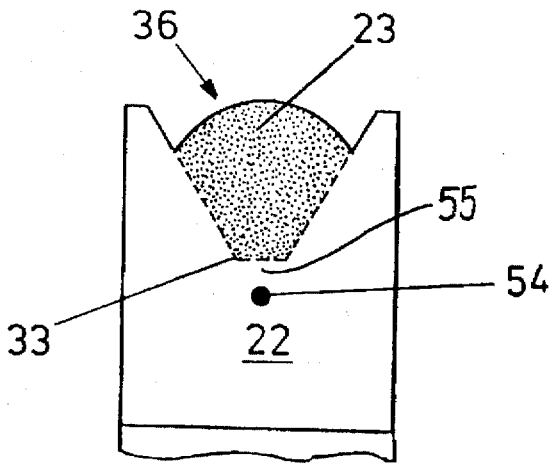
FIGS. 8–10 each show an exemplary embodiment of a seal for sealing the dispensing opening.
Figure 9:
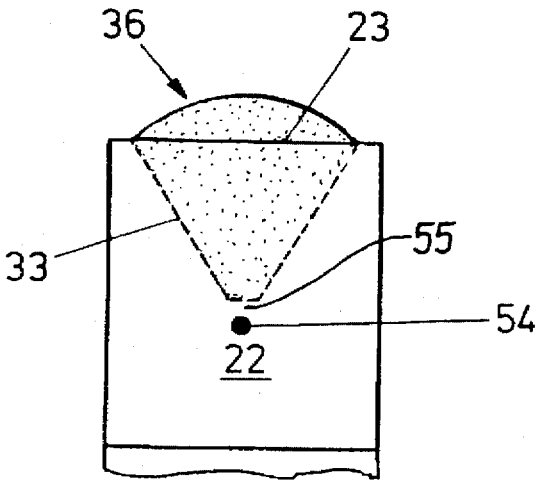
Figure 10:
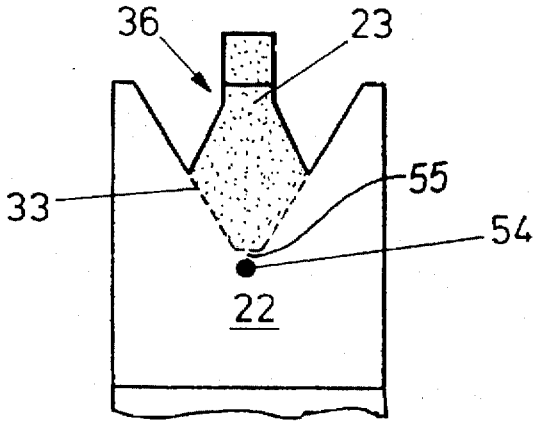

It goes without saying that the seals 23 can be designed in a large number of ways. FIGS. 8–10 show a number of possible variants of seals 23, which are each connected with a top panel 22.

Figure 11:
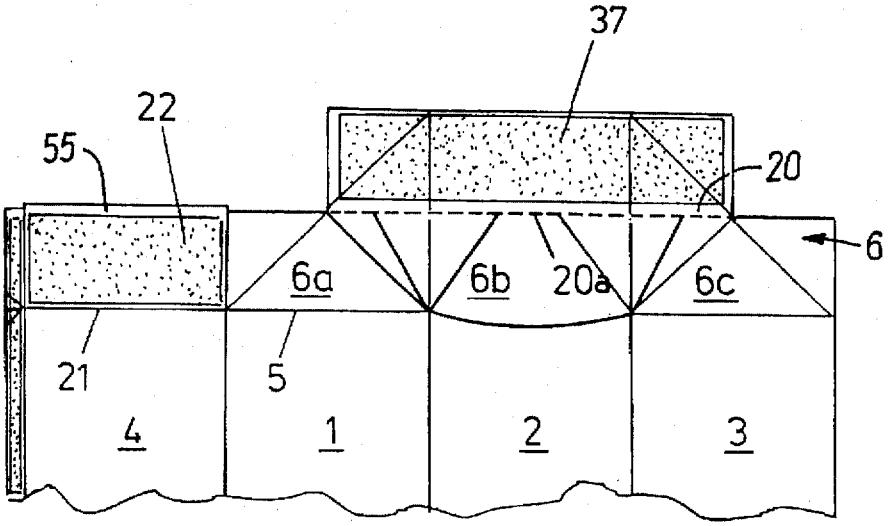
FIGS. 11–14 each show a part of a blank for manufacturing a box where the seal is connected indirectly with a sidewall.
Figure 12:
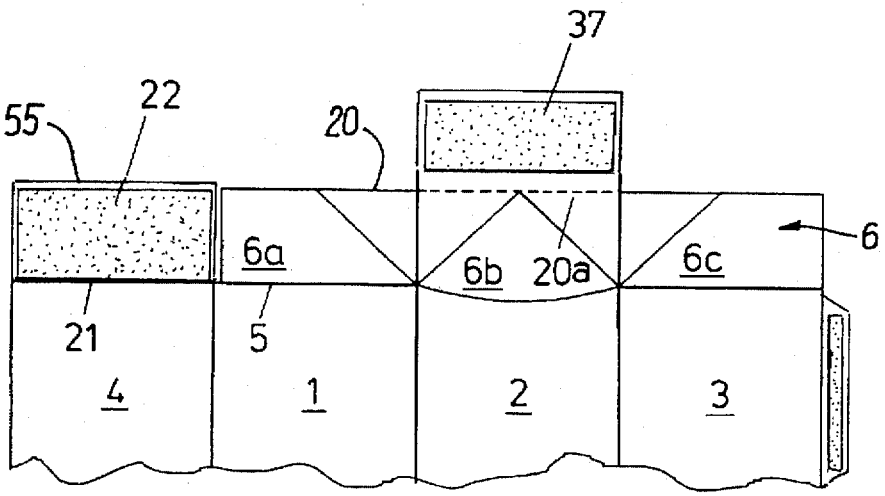
Figure 13:
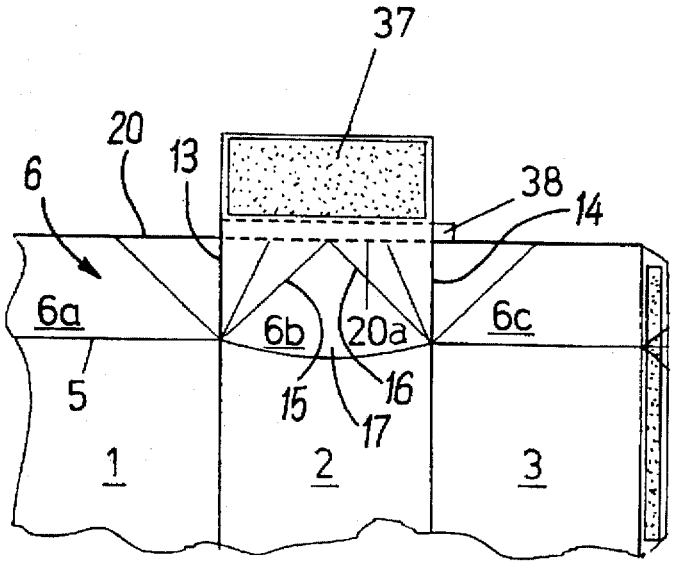
Figure 14:
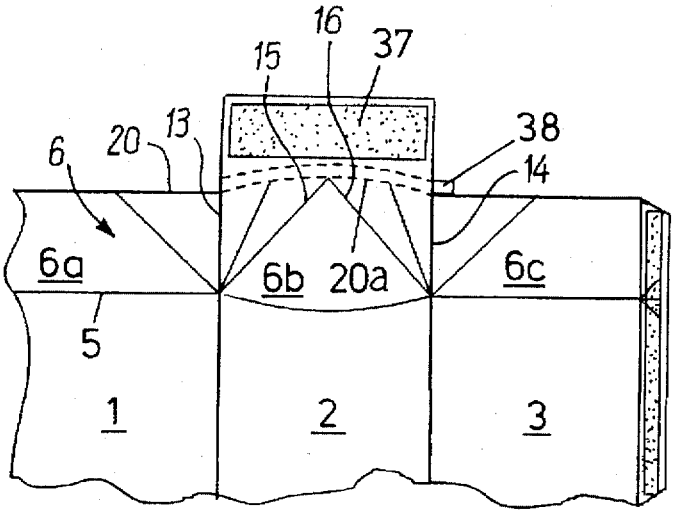

FIGS. 11–14 show a number of blanks of alternative embodiments of the box according to the invention, in which dispensing opening panel 6, at the opening edge 20 and remote from the upper edge 5 of the sidewalls 1, 2, 3, is connected with a sealing panel 37, at least at the location of the central dispensing opening panel section 6*b*, through at least one perforation or tear line 20*a*. All blanks shown in FIGS. 11–14 comprise a fourth sidewall 4 which, at the upper edge 21, is connected with a top panel 22 which substantially covers half the top of the packaging, while the top panel 22 and the sealing panel 37, in the unopened condition of the box, are connected with each other through adhesive. As shown in FIG. 11, the sealing panel 37 may also be connected with the dispensing opening panel sections 6*a*, 6*c*, adjacent to the first and third sidewalls 1 and 3. Such an extended sealing panel 37 provides a doubling of the seal to be broken, in that when the blank is folded in the box configuration, the portions of perforation line 20*a* dispensing panel sections 6*a* and 6*c* overlap the portion of perforation line 20*a* of dispensing panel section 6*b*. Accordingly, to initially open the package of FIG. 11, two overlapping portions of tear of perforation line 20*a* must be broken simultaneously, so that the chances of the seal being broken unintentionally are minimized. Moreover, it can be particularly advantageous when the perforation or tear line 20*a* is of slightly curved or bent design as shown in FIG. 14, such that the central dispensing opening panel section 6*b* is slightly wider at least in the middle. The opening edge 20 provided when the slightly curved tear line 20*a* is opened allows the dispensing opening during closure to be clamped under the top panel 22 by the projecting, slightly curved or bent edge 20. Accordingly, the means for positively keeping the dispensing opening in the reclosed position are here formed in part by the projecting, slightly curved or bent edge 20.

Figure 15:
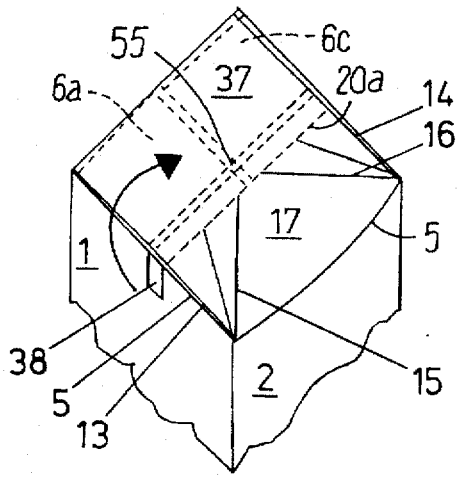
FIGS. 15–17 show the opening of a third exemplary embodiment of a box the blank of which is shown in FIG. 13.
Figure 16:
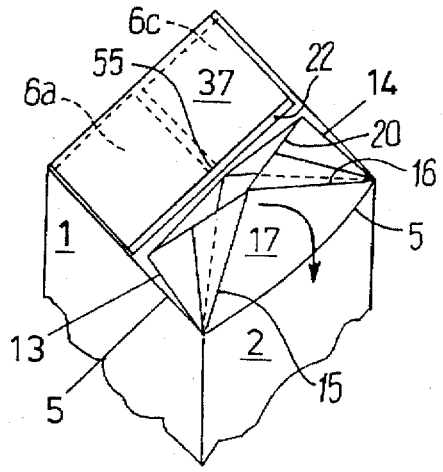
Figure 17:
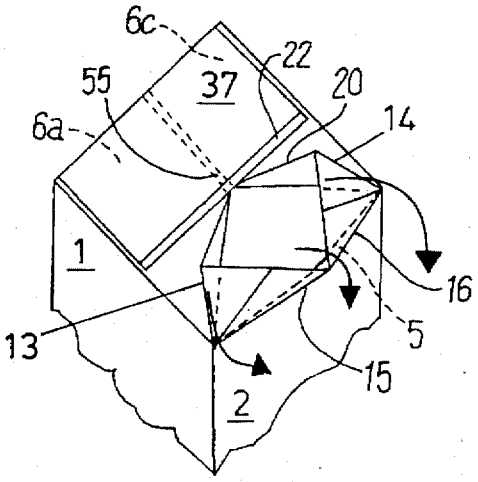

FIGS. 15–17 are perspective views of the manner in which the box which has been made from the blank of FIG. 13 is opened. FIG. 15 shows the box in closed condition, the arrow indicating how the tearing strip 38, formed by perforation line 20*a*, is to be removed. It can be clearly derived from FIG. 16 that the dispensing opening panel fold lines 13, 14 in the closed condition are located on the upper edge 5 of the first and third sidewalls 1 and 3, respectively.

Figure 18:
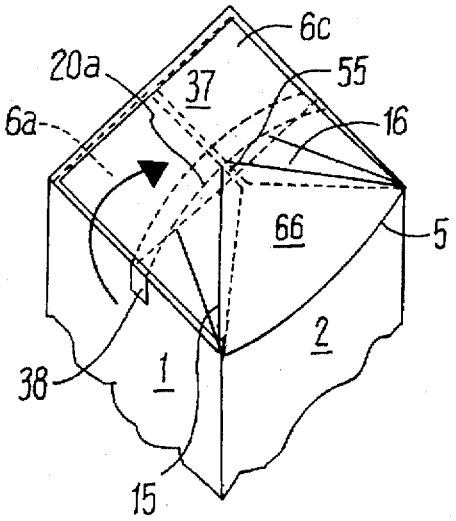
FIG. 18 shows a fourth exemplary embodiment of a box the blank of which is shown in FIG. 14.

FIG. 18 shows a perspective view of the box obtained from the blank according to FIG. 14.

Figure 19:
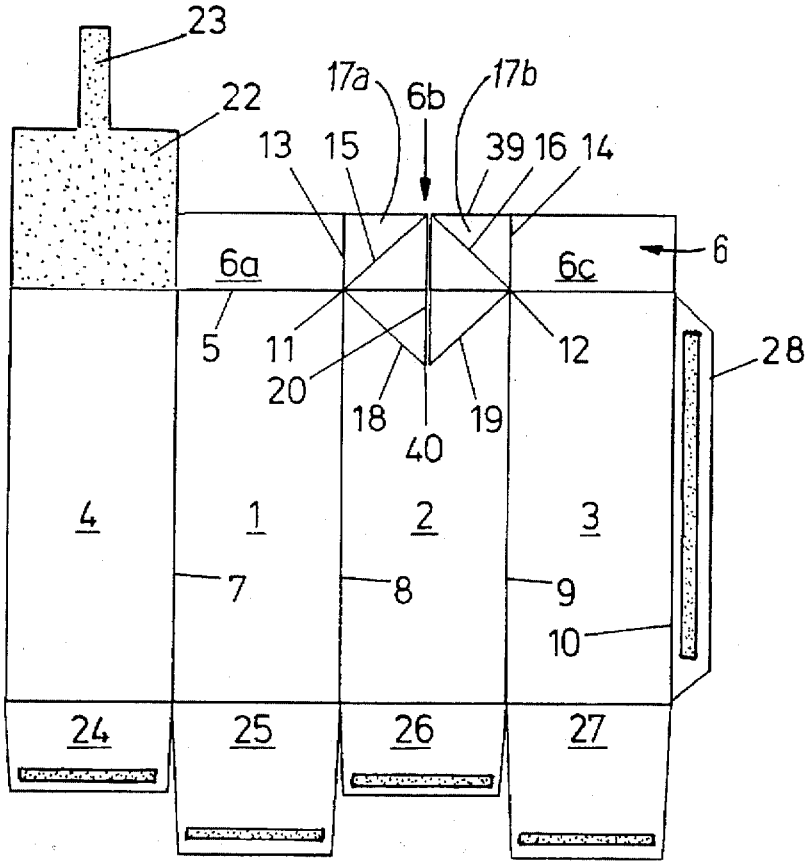
FIG. 19 shows a blank of a fifth exemplary embodiment.
Figure 20:
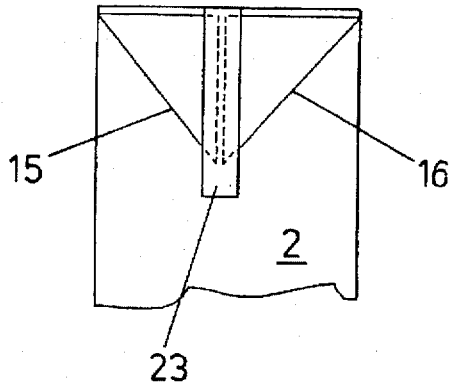
FIG. 20 shows a partial front view of the fifth exemplary embodiment the blank of which is shown in FIG. 19, with the dispensing opening in the closed condition.
Figure 21:
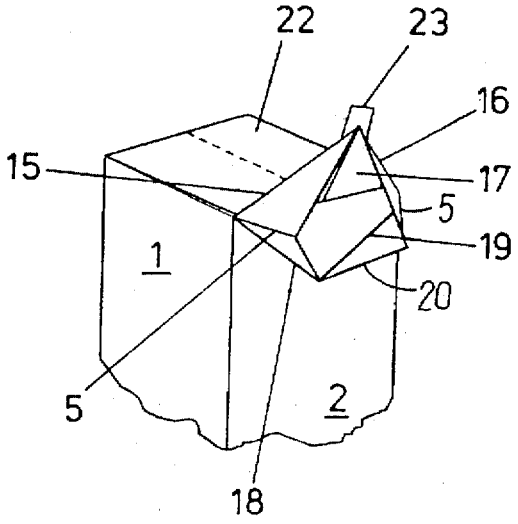
FIG. 21 shows a perspective view of the dispensing opening of the fifth exemplary embodiment in opened condition.

FIGS. 19–21 relate to another embodiment of the invention, which is particularly suitable for products which must be used up completely directly after the packaging is opened. The fold lines, surfaces and edges of the blank shown in FIG. 19, to the extent where they have the same function as the fold lines, surfaces and edges of the blank shown in FIG. 1, are designated by the same reference numerals as in FIG. 1. In this exemplary embodiment, the opening edges 20, bounding the dispensing opening, are formed by a cut, provided in the central sidewall 2 of the three adjoining sidewalls 1–3 and the dispensing opening panel section 6b connecting thereto. In the embodiment of the blank of FIGS. 19–21, the opening edge 20 extends parallel to the edges 7–10, from the middle of the free edge 39 of the central dispensing opening panel section to a point 40 located on the central sidewall 2. The point 40 is equidistantly spaced from the edges 8 and 9 bounding the central sidewall 2. A dispensing surface 17 is provided by portions 17a, 17b of middle dispensing opening panel section 6b. With a packaging of such design, a large dispensing opening is created by means of which the packaging can be emptied at once in its entirety. Optionally, the closing tab 23 may be provided with an adhesive which can be used several times. In that case the packaging is reclosable and may also be emptied partly and be closed again. When emptying the packaging, it should be emptied with the top facing down, so that the contents of the packaging can indeed be dispensed by way of the dispensing surface 17 in a directed manner.

The sprinkle or pour opening is particularly suitable for liquids in that the dispensing surface provides the possibility of dispensing the contents of the packages in a directed manner. To that end, however, it is of essential importance that all connections between walls are substantially liquid-tight and are preferably formed by fold lines, thus keeping number of wall portions interconnected through adhesive to a minimum.

Figure 22:
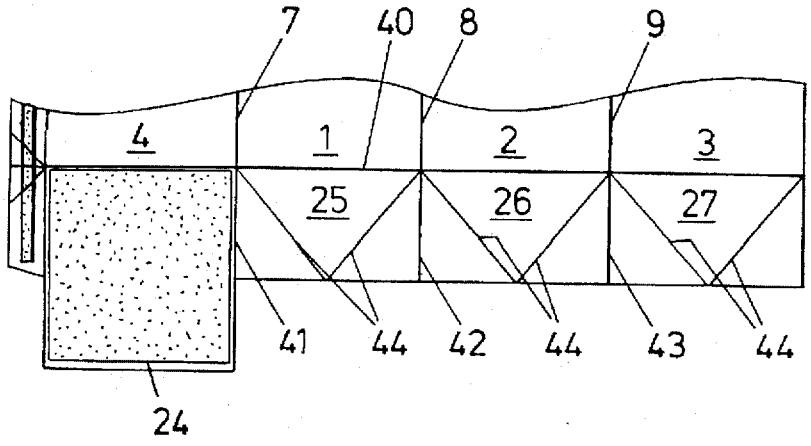
FIG. 22 shows an elevation of the lower end of the blank of a liquid-tight embodiment of the box.

Thus FIG. 22 shows the lower end of a blank which is characterized in that each sidewall 1–4 is connected with a bottom panel 24–27 through a lower edge 40. The bottom panels 24–27 are interconnected through fold lines 41–43 extending in the blank in the prolongation of the edge fold lines 7–9. The bottom panels 24–27 comprise slanting fold lines 44 which enable the bottom panels 24–27 to be folded towards each other for folding up the box.

Figure 23:
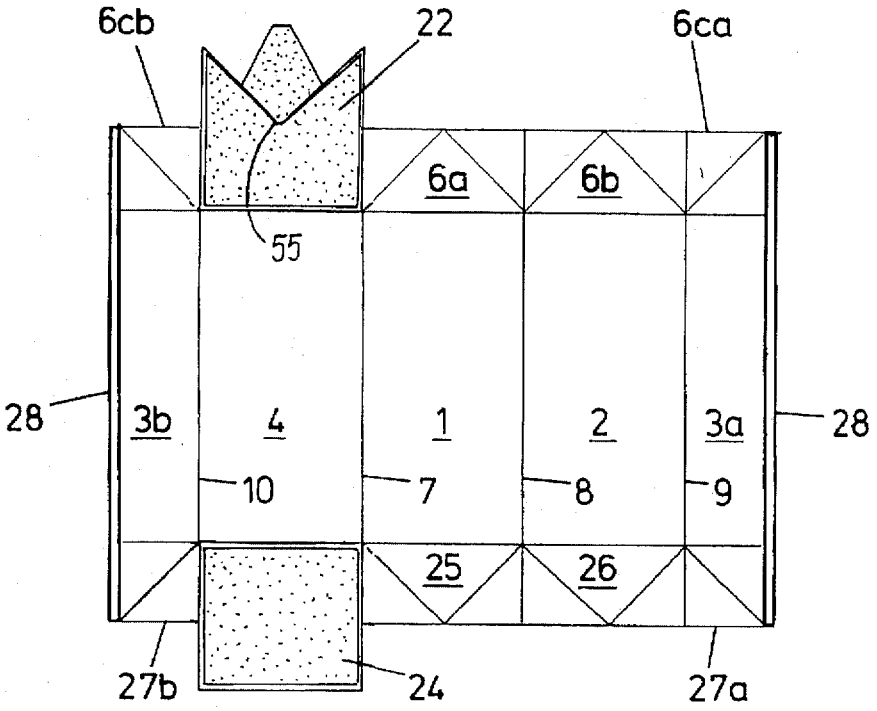
FIG. 23 shows an elevation of a blank of an exemplary embodiment of the box which can be produced as a tube.
Figure 24:
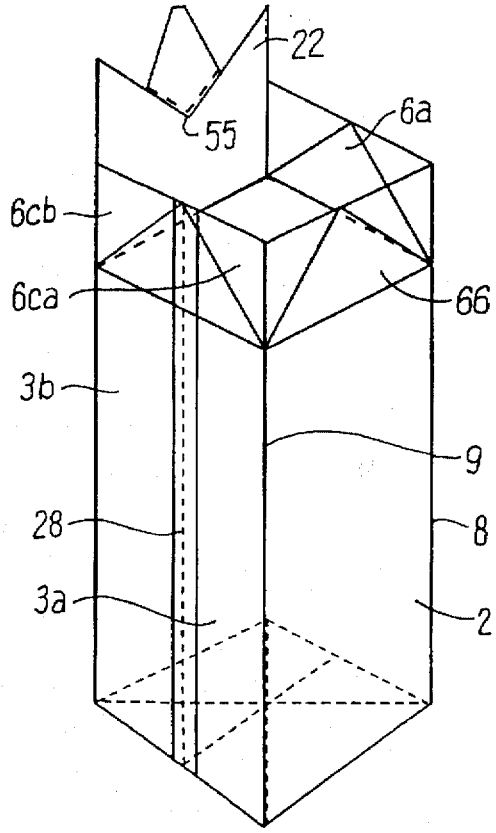
FIG. 24 shows a perspective view of the box produced as a tube, where the top with the dispensing opening has not been folded up yet.

A box with a minimum of adhesive edges which is very simple to produce and to manufacture and therefore can be manufactured to be moisture-proof in a simple manner is shown as a blank in FIG. 23 and in partly folded condition in FIG. 24. This box is characterized in that the sidewalls 1, 2, 3a, 3b, 4 are all connected through fold lines 7–10 at the edges. Two adhesive edges 28 for forming the blank into a box extend substantially parallel to the edges 7–10 and are located in a sidewall 3. To obtain a box in which the chances of leakage are minimized, all bottom panels 24, 25, 26, 27a, 27b can be connected with each other through fold lines, as can the dispensing opening panel 6a, 6b, 6ca, 6cb and the panel 22. With connected bottom panels and connected top panels, only bottom panel 24 and top panel 22 need be provided with an adhesive layer for the closure of the box-like packaging. FIG. 24 shows the box in partly folded condition, where the sidewalls 1–3 are connected with each other through the adhesive edges 28 and the bottom panels 24–27 have already been folded. In this condition, the box can be simply filled and subsequently be closed. It will be clear that this box, like all of the other exemplary embodiments, features parallel tops and bottoms and therefore is stackable. Moreover, the waste space in the box when it is filled is minimal and the chances of spillage as the sprinkle or pour opening is being opened are extremely small since the opening extends above the box. By virtue of the absence of empty space containing air and hence bacteria, and by virtue of the box being highly moisture-proof, the box is eminently suitable for storing perishable liquids such as, for instance, milk or yoghurt.

Figure 25:
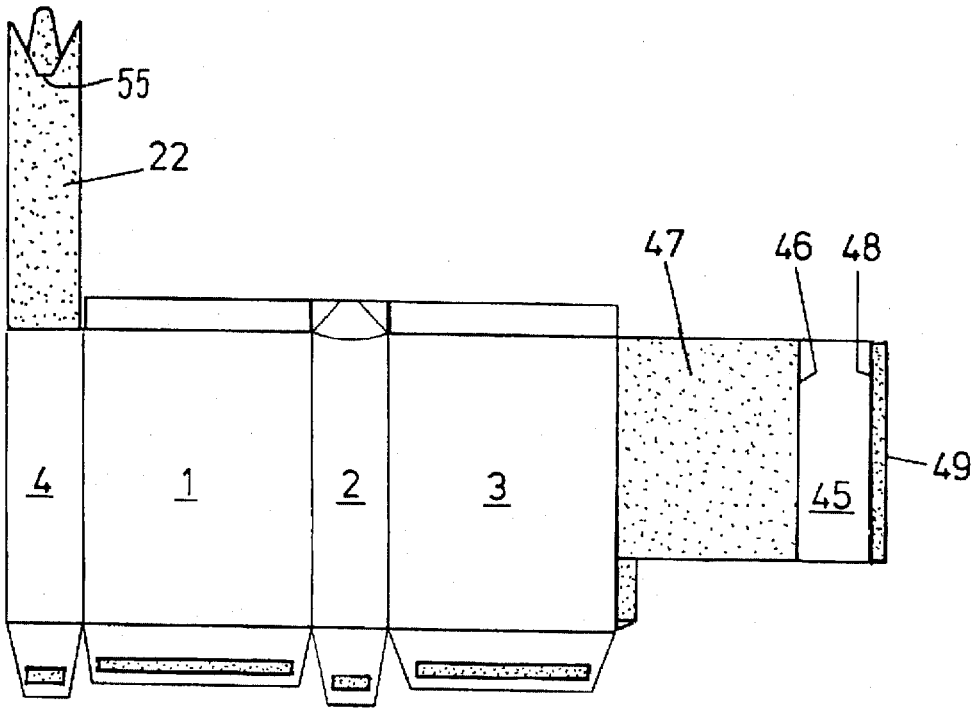
FIG. 25 shows a blank of a rectangular box with a filling compartment.
Figure 26:
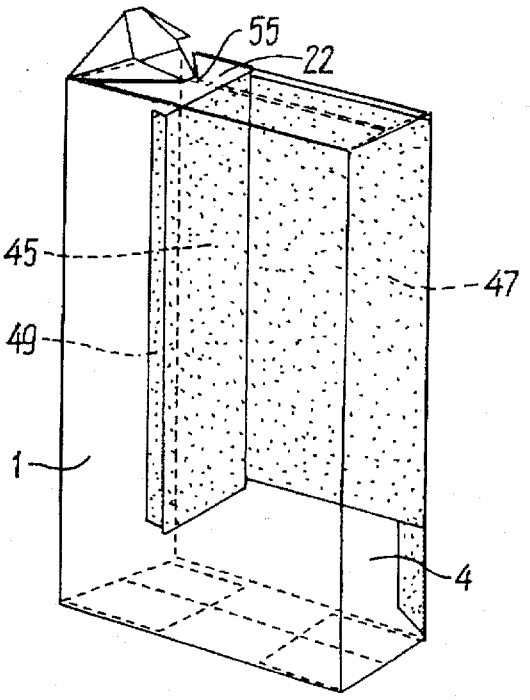
FIG. 26 shows a perspective view of a sixth exemplary embodiment of the box the blank of which is shown in FIG. 25.

FIGS. 25 and 26 show an embodiment of a box, which is rectangular in this case, which incorporates a chute partition 45 which extends at least over a part of the vertical section of the box for forming a compartment. Such a compartment provides the possibility of dispensing the contents of the box in dosed manner. In the exemplary embodiment shown, the chute partition 45, at a first longitudinal edge 46 thereof, is connected with one of the sidewalls 3 of the box through a connection panel 47. At the second longitudinal edge 48, remote from the first longitudinal edge 46, the chute partition 45 is connected with an adhesive strip 49. FIG. 26 depicts the box in folded condition.

One or a number of the fold lines described may optionally be of slightly curved or bent design. According to a particularly advantageous embodiment of the invention, the upper edge 5, which is connected with dispensing opening panel section 6b, which contains the dispensing surface 17, is of slightly curved design and substantially traverses, for instance, an arc of a circle whose imaginary center is located centrally above the central sidewall 2 of the three adjoining sidewalls 1–3. An upper edge 5 of such design ensures that the dispensing opening automatically closes itself further from a particular position as a result of the tension created in the cardboard by the curved fold line 5.

In an alternative embodiment, the upper edge 5 traverses an arc of a circle of which the imaginary center is located below the upper edge 5 in the central sidewall 2. An upper edge 5 of such design ensures that the dispensing opening opens automatically from the closed position. Such a design is suitable in particular with packagings comprising means for positively retraining the dispensing opening in the reclosed position.

With some types of material, such as for instance corrugated cardboard, it may be necessary to make at least one of the fold lines of double or multiple design. The dispensing opening panel fold lines 13 and 14, in particular, are eligible for this.

To open the box, the seal 23 should naturally be pulled loose first, either leading to the opening being cleared automatically or requiring that the top of the top panel 22 be pressed upon. For that purpose, a marker point 54 may be provided, for instance on the top panel 22.

Figure 27:
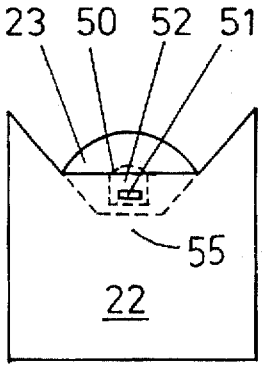
FIG. 27 shows a top plan view of a seal with gripping tab.
Figure 28:
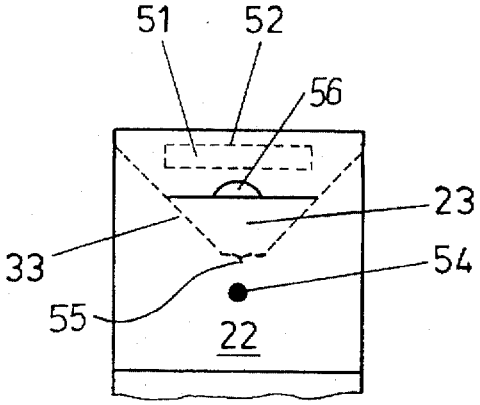
FIG. 28 shows a top plan view of a seal with a gripping tab of different design.

FIGS. 27 and 28 show yet further configurations of the top panel 22 and seal 23 which can be alternatively used such as with the box of FIGS. 1–7. As shown in FIGS. 27 and 28, the seal 23 may be provided with a gripping tab 52 connected with the seal 23 or with the top panel 22 through perforation lines 50 and with the dispensing opening panel 6 (shown in FIGS. 1–7) through adhesive 51. In the embodiment according to FIG. 27, the gripping tab 52, upon removal of the seal 23, is torn loose through the perforation line 50 of the seal 23 and remains attached to the dispensing opening panel 6 through the adhesive 51. Then the user can open the dispensing opening with the gripping tab 52. In the embodiment according to FIG. 28, the seal 23 can be readily gripped and removed via the nail hole 56, whereafter the gripping tab 52 can be gripped through engagement via the same nail hole 56, whereby the perforation which connects the gripping tab 52 with the top panel 22 is broken during opening. The thus designed gripping tab 52, which projects slightly on opposite sides of the dispensing surface 6, at the same time serves as an anti push-through provision preventing the user from pushing the dispensing opening into the interior of the box during reclosure.

Figure 29:
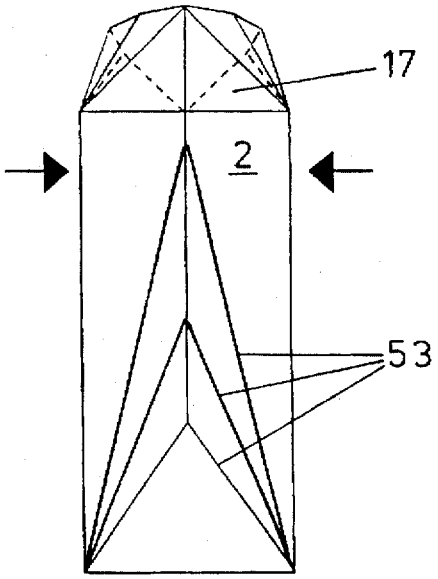
FIG. 29 shows an elevation of a folding box with additional fold lines in a sidewall adjacent the dispensing opening.

Another method of opening the dispensing opening can be effected by slightly compressing the sidewall 2 adjoining the central dispensing opening panel section 6b in a direction perpendicular to the first and third sidewalls 1 and 3, respectively. In particular when the upper edge 5 of the second sidewall is of slightly curved design, the consequence of such compression will be that the dispensing surface 17 partly springs upwards and can then be gripped by hand to be unfolded further. In order to facilitate the compression of the second sidewall 2, it is particularly advantageous when the second sidewall 2, adjoining the dispensing surface 17, comprises a number of fold lines 53 which are provided in a manner such as to allow the sidewall 2 to bulge. Such fold lines 53 are shown in FIG. 29. Also, arrows indicate in what way the second sidewall 2 can be compressed.

In order to keep the top of the box as flat as possible, it is particularly advantageous in accordance with a further elaboration of the invention, when, in the case of boxes comprising four sidewalls, the dispensing opening panel sections 6*a*, 6*c*, connected with the outer sidewalls 1, 3 of the three adjoining sidewalls 1–3, have a height which corresponds with half the width of the central sidewall 2 of the three adjoining sidewalls 1–3. This prevents partial overlap of the dispensing opening panel sections 6*a* and 6*c* in the folded condition of the box, which would lead to a non-flat top of the box.

Optionally, the box-like packaging may comprise a closed inner pocket, incorporated in the packaging, which is connected with the dispensing opening in such a manner that the inner pocket is torn open when the dispensing opening is being opened. Such a packaging is suitable, for instance, for products to be vacuum packed, such as, for instance, coffee or cornflakes.

It will be clear that the invention is not limited to the exemplary embodiments described but various modifications are possible without departing from the scope of the invention. Thus, for instance, a box may comprise two dispensing openings each constituting the opening of two mutually separate compartments in the box.

I claim:

1. A box manufactured from one material portion, comprising:

at least three adjoining sidewalls successively connected through fold lines which form edges of the box;

a bottom panel which closes the box at an underside of the box, the bottom panel connected through a fold line to one of the sidewalls at a lower edge of said one of the sidewalls, the bottom panel being substantially flat;

a top panel which is substantially flat and extends substantially parallel to the bottom panel, the top panel defining a dispensing opening which can be passed from a closed position to an open position through folding, said dispensing opening comprising a dispensing opening panel connected to one of the sidewalls through at least one curved fold line, the curved fold line creating tension in the sidewall for urging the dispensing opening in one of the open position and the closed position, means for sealing the dispensing opening integrally connected with the box; and means which positively keep the dispensing opening, once it has been opened, in a reclosed position.

2. A box according to claim 1, wherein the box has upper corners at intersections of the top panel with two of the three adjoining sidewalls, wherein the dispensing opening panel is connected to each of the three adjoining sidewalls through a fold line, wherein the fold lines forming the edges of the box and interconnecting said three adjoining sidewalls continue as dispensing opening panel fold lines into the dispensing opening panel, whereby the dispensing opening panel is divided into at least three dispensing opening panel sections; wherein the curved fold line extends between the upper corners of the box at a downward angle with the dispensing opening panel fold lines and further comprising a second fold line extending between the upper corners of the box at an angle with the dispensing opening panel fold lines.

3. A box according to claim 2, wherein opening edges bounding the dispensing opening are formed by the edge of the dispensing opening panel remote from the three adjoining sidewalls, so that the dispensing opening fold lines are located in the dispensing opening panel sections bounding a central dispensing opening panel section, and wherein the means which positively keep the dispensing opening in a reclosed position are top panel material portions under which a part of the dispensing opening panel can be snapped for bringing the dispensing opening into the reclosed position.

4. A box according to claim 1, wherein the box, in addition to the three adjoining sidewalls, comprises a fourth sidewall which has an upper edge connected with the top panel through a fold line, the sidewalls extending perpendicularly to each other.

5. A box according to claim 2, further comprising bulge fold lines, extending from the upper corners in the dispensing opening panel.

6. A box according to claim 2, wherein the top panel is a substantially rectangular material portion, which is provided with a substantially triangular recess in which a part of the dispensing opening panel is receivable, the recess being partly filled by a removable sealing flap which is connected with the top panel through a perforation line.

7. A box according to claim 3, wherein the dispensing opening panel is connected with a sealing panel, at least at the location of the central dispensing opening panel section, through at least one separation line.

8. A box according to claim 7, wherein the box comprises a fourth sidewall having an upper edge connected with the top panel which covers substantially half the top side of the box, the top panel and the sealing panel being connected with each other through adhesive in the unopened condition of the box.

9. A box according to claim 7, wherein the separation line is of slightly curved or bent design, such that the central dispensing opening panel section is slightly wider at least in the middle.

10. A box according to claim 1, wherein all connections between the sidewalls are substantially liquid-tight.

11. A box according to claim 10, wherein each sidewall has a lower edge connected with the bottom panel through fold lines which extend in the prolongation of the edge fold lines, the bottom panel having slanting fold lines to enable the bottom panel to be folded perpendicular to the sidewalls for the purpose of forming the box.

12. A box according to claim 1, further comprising an adhesive edge for forming the box, the adhesive edge extending substantially parallel to the edges of the box.

13. A box according to claim 1, further comprising a chute partition which extends at least over a part of one of the sidewalls for forming a compartment.

14. A box according claim 13, wherein the chute partition is connected with one of the sidewalls through a connection panel.

15. A box according to claim 1, wherein the curved fold line is formed of a plurality of small, straight fold lines connected to each other at angles.

16. A box according to claim 1, wherein at least one of the fold lines is of multiple design.

17. A box according to claim 3, wherein one of the sidewalls comprises a number of fold lines, provided in such a manner as to allow the sidewall to bulge.

18. A box according to claim 3, wherein a marker point is provided on the top panel.

19. A box according to claim 2, wherein the dispensing opening panel sections have a height which corresponds with half of a width of a central one of the three adjoining sidewalls.

20. A blank for manufacturing the box of claim 1.

* * * * *